United States Patent [19]

Chang

[11] 4,244,709

[45] Jan. 13, 1981

[54] HIGH INTENSITY IONIZATION-ELECTROSTATIC PRECIPITATION SYSTEM FOR PARTICLE REMOVAL AND METHOD OF OPERATION

[75] Inventor: Ching M. Chang, Williamsville, N.Y.

[73] Assignee: Union Carbide Corporation, New York, N.Y.

[21] Appl. No.: 57,498

[22] Filed: Jul. 13, 1979

[51] Int. Cl.[3] ..... B03C 3/12

[52] U.S. Cl. ..... 55/2; 55/138

[58] Field of Search ..... 55/2, 136, 137, 138

[56] References Cited

U.S. PATENT DOCUMENTS 4,108,615 8/1978 Satterthwaite ..... 55/2

OTHER PUBLICATIONS

R & D Status Report Fossil Fuel and Advanced Systems Division, EPRI Journal, pp. 25–32, No. 9, Nov. 1976.

High Intensity Ionizer for Improved ESP Performance, EPRI Journal, pp. 56–61, Jun./Jul., 1977.

Test Program for an Ionizer–Precipitator Fine Particle Dust Collection System, Air Pollution Control Association, H. W. Spencer III et al, 1977.

Electric Power Research Institute Advanced Emissions Control Facility, Western Precipitation Division, Joy Manufacturing Co., 1977.

*Primary Examiner*—David L. Lacey

*Attorney, Agent, or Firm*—John C. Le Fever; Lawrence G. Kastriner

[57] ABSTRACT

Fine particles are removed from a gas stream by successive passage through an upstream plate-wire electrode type electrostatic precipitation (ESP), a high intensity ionization (HII), and a downstream electrostatic precipitation, all in accordance with a predetermined ESP particle collection area relationship.

8 Claims, 8 Drawing Figures

FIG. 1
(PRIOR ART)
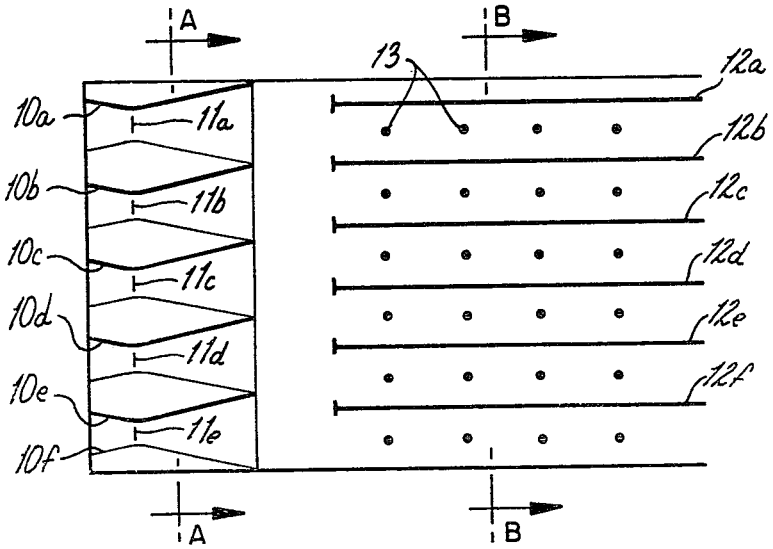
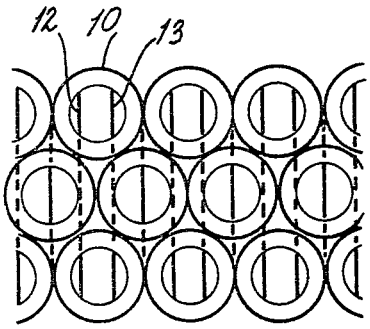
FIG. 2
(PRIOR ART)
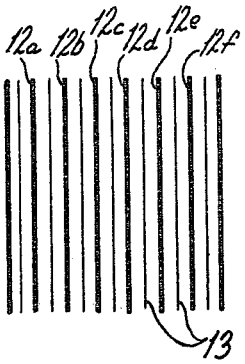
FIG. 3
(PRIOR ART)

HIGH INTENSITY IONIZATION-ELECTROSTATIC PRECIPITATION SYSTEM FOR PARTICLE REMOVAL AND METHOD OF OPERATION

BACKGROUND OF THE INVENTION

This invention relates to a method of and apparatus for removal of fine particles from a gas stream, for example fly ash particulates from the gaseous emissions of a coal-fired electrical generating power station.

Along with rapid industrial growth over the last two decades, there has been an alarming increase in the discharge of harmful pollutants into the environment. Unfortunately, the necessary pollution abatement technology to minimize, or eliminate the discharge of industrial waste material and its harmful effects has not kept pace with overall technological growth. To stimulate the needed pollution control innovations, stringent standards have been imposed on industry requiring the reduction or total elimination of particulate discharge in the atmosphere.

Schwab et al U.S. Pat. Nos. 4,093,430 and 4,110,806 describe a recent technological advancement in air pollution control, in particular the removal of fine particles of 0.1 μm to 3.0 μm diameter. These patents describe a high intensity ionization system (hereafter referred to as "HII system") wherein a disc-shaped discharge electrode is inserted in the throat of a Venturi diffuser. A high D.C. voltage is imposed between the discharge electrode or cathode and the Venturi diffuser, a portion of which acts as an anode. The high voltage between the two electrodes and the particular construction of the cathode disc produces a stable corona discharge therebetween of a very high intensity. Particles in the gas which pass through the electrode gap of the Venturi diffuser are charged to very high levels in proportion to their sizes. The entrained particulates are field charged by the strong applied field and by ion impaction in the region of corona discharge between the two electrodes. The high velocity of the gas stream through the Venturi throat prevents the accumulation of space charge within the corona field established at the electrode gap and thereby improves the stability of the corona discharge between the two electrodes.

In the further HII improvement of Satterthwaite, U.S. Pat. No. 4,108,615, jets of cleaned air are introduced along the anode wall to prevent particle deposition thereon and to mechanically remove excess deposits from the anode, thus preventing the onset of back corona.

Although the HII device can be used as a precharger for a variety of particle collection devices including fabric bags, Venturi scrubbers, fixed and fluidized bed collectors, in its principal use the HII device is used as a precharger for an electrostatic precipitator assembly. In this use, the entire HII system is functionally analogous to a conventional two-stage electrostatic precipitator,, although the HII operates as a much more effective precharger than the wire-plate ionizer stage of the two-stage precipitator used, for example, as a room air purification device.

In the drawings, FIGS. 1–3 represent prior art apparatus. As illustrated in the cross-section elevation view of FIG. 1, each HII comprises a tubular Venturi-shaped anode 10*a* through 10*f* and a disc-shaped cathode 11*a* through 11*f* positioned within the anode. FIG. 2, a cross-section end view of FIG. 1 taken along line A—A, illustrates alignment of the individual HII devices with their respective axes parallel to one another, to thereby present a honeycomb-like array of flow passages to the particulate laden gas stream. The discharge end of the HII is then aligned directly in front of an electrostatic precipitator, shown as FIG. 3, a cross-sectional end view taken along line B—B of FIG. 1.

The electrostatic precipitator comprises a series of grounded, equally spaced parallel plates 12*a* through 12*f* which serve as the collecting electrodes. Spaced uniformly between these plates are electrically charged wires 13 which function as discharge electrodes and thereby establish an electric field between the wires and plates. As illustrated, there are four wires 13 between each pair of plates. Charged particles from the HII unit which enter the electrostatic precipitator are forced by the electric field to an appropriate electrode and are thereby collected. The trapped solids are thereafter removed by mechanically rapping the collector electrodes. The collected particulates then fall by gravity into a collection hopper located in a chamber directly below the electrostatic precipitator. A detailed description of a standard electrostatic precipitator is presented in Chapter 2 of *Industrial Electrostatic Precipitation,* Harry J. White, Addison-Wesley Publishing Company, Inc., Reading, Massachusetts, 1963.

While a system incorporating the HII device as described in the aforementioned Schwab et al patents represents a significant improvement relative to prior art particulate collection assemblies, it nonetheless has a significant drawback which impairs the overall particle collection efficiency of the HII—electrostatic precipitator assembly.

In order to insure optimum operation, a uniform flow of gas must be established through the electrostatic precipitator assembly. One way to establish uniform gas flow without significantly increasing the pressure drop of the entire system is to provide a sizeable plenum chamber between the HII outlet and the electrostatic precipitator inlet. A uniform flow of gas through the electrostatic precipitator assembly with a uniform particle concentration is essential for a variety of reasons. First of all, in order to insure that the collection area is being used to its fullest potential, it is necessary that no particulate loading gradient or particle size stratification exist between neighboring collector passages. Such a loading gradient and size stratification would reduce the overall effectiveness of those collector plates which have to remove a non-proportionally large share of the entrained solids. As a result, it is necessary that a gas having a uniform concentration of particulates be uniformly distributed among the various parallel flow channels provided by the electrostatic precipitator design.

Another reason why uniform gas flow and particle concentration is important is to minimize scouring and reentrainment of collected particulates. To accomplish this, it is necessary to keep all of the local gas velocities near each of the collector electrodes as close to the mean flow velocity as possible. This condition can best be satisfied by insuring that the gas is initially distributed to the various flow channels of the electrostatic precipitator assembly as uniformly as possible. This will provide nearly identical localized gas velocities. Such uniform velocities also insure that particle residence times are uniform throughout. The resultant migration velocity of a particulate between any two electrodes in an electrostatic precipitator is primarily determined by the drag experienced by the particle while moving toward the electrodes, which opposes collection, and the electric field force on the particle normal to the electrodes which contributes to collection. A particle's residence time is directly influenced by the velocity of the gas stream within which it is entrained. High localized velocities due to maldistribution of flow, therefore, will reduce the residence time available for particle migration and accordingly reduce collection efficiencies; while uniform velocities will insure that the electrostatic precipitator assembly as a whole operates with the most optimal collective forces.

A final reason for achieving uniform gas flow and particle concentration is that non-uniform conditions may under certain circumstances, lead to a localized sparking between neighboring discharge and collector electrodes. Sparking is the rapid breakdown of the electric field between neighboring electrodes which serves to significantly degrade collection efficiency. Sparking may discharge already charged particulates, and may even produce particles of an opposite polarity to those produced by the HII device. In either case, overall efficiency suffers.

However, the mere presence of the plenum chamber for insuring a uniform flow itself causes additional problems in the operation of the integrated HII-electrostatic precipitator system for which the prior art has not yet provided solutions. The principal problem involves the so-called space charge phenomenon. In broad terms, "space charge" refers to a perponderance of negative ions within any given portion of the plenum chamber between the HII assembly and the electrostatic precipitator assembly. When an inordinately large accumulation of negative ions occurs in the plenum chamber of the HII-electrostatic precipitator assembly, there is a high likelihood for localized discharge or neutralization of the charged particles by arcing or spark-over to grounded protrusions inside the plenum chamber. The discharge produces neutral or even positively charged particles which cause a net reduction in the overall charge on entrained particles and inferior operation. The extent or degree of the accumulation of "space charge" varies directly with the size of the plenum chamber.

This space charge effect has a major impact on the overall collection efficiency of particles, especially fine particles. In order to satisfactorily comply with air quality standards in the majority of the cases involving the removal of airborne particulates, a major portion of the fine particulates must be removed. Adequate removal of fine particles in an electrostatic precipitator requires that they be highly charged prior to entering the electrostatic precipitator assembly, so that the applied electric field force therein is sufficient to effect particle collection. The electrostatic precipitator alone cannot adequately provide the required charging to sufficiently remove fine particles.

It has been found that the HII is uniquely suited for providing the needed charge on fine particles. However, the effectiveness in fine particle collection gained by employing the HII is disadvantageously diminished when arcing or spark-over occurs. The charges on the fine particles are reduced or eliminated and some particles may avoid collection in the downstream electrostatic precipitator.

An object of this invention is to provide an improved high intensity ionization-electrostatic precipitation system for separation of fine particles from gas streams.

Another object is to provide an improved high intensity ionization-electrostatic precipitation assembly with reduced sparking and higher particle removal efficiency.

Other objects and advantages will be apparent from the ensuing disclosure and appended claims.

SUMMARY

This invention relates to a method of and apparatus for separating fine particles from a gas stream by high intensity ionization and electrostatic precipitation.

It has been determined that the degree of arcing or sparking due to the space charge phenomenon can be controlled by regulating the inlet particle loading of the HII assembly. In fact, I have discovered that the optimum location for any given HII assembly (although influenced by a wide variety of factors in any given electrostatic precipitator design) is typically between the serially arranged electrostatic precipitator fields rather than prior to the entire electrostatic precipitator assembly, as generally practiced by the prior art.

Based solely upon the consideration of maximum use of the HII charging potential alone, one would typically place the HII assembly at the upstream-most location, prior to all of the electrostatic precipitator fields as is currently practiced. Alternatively, based on a space charge analysis alone, one would typically locate the HII sufficiently downstream so that the particle loading of the HII assembly is such that the charged particulates discharged from the HII assembly do not create a space charge in the cavity or plenum downstream thereof sufficient to cause sparking. However, I have unexpectedly determined that by locating the HII array at a predetermined position between these two locations and potentially sacrificing the overall efficiency of the HII assembly due on the one hand to less complete use of the HII charging potential, and on the other hand to the possibility of occasional arcing or spark-over due to the space charge phenomenon, that the overall efficiency of the HII-electrostatic precipitator assembly is in fact increased relative to either of these two prior locations. The result is that both of these prior deficiencies are optimally minimized. I have discovered that for a given HII-electrostatic precipitator design and particulate laden gas stream composition, there is unique HII position between two serially arranged electrostatic precipitators that optimizes the overall collection efficiency of the system.

More specifically, one aspect of the invention relates to a method for removing fine particles from a feed gas stream in which the particles in the feed gas stream are charged in a single high intensity ionization step and the charged particles are thereafter collected in a downstream plate-wire electrode type electrostatic precipitation step. The improvement comprises first passing the fine particle-containing feed gas stream through an upstream plate-wire electrode type electrostatic precipitation step prior to said charging at substantially the same gas velocity as the downstream electrostatic precipitation step, with the upstream particle collection area $A_I$ in said upstream plate-wire electrode type electrostatic precipitation step and the downstream particle collection area $A_D$ in said downstream plate-wire electrode type electrostatic precipitation step in accordance with the following formulas:

$$A_I = A_T \text{ times } X \quad (1)$$

where $A_I$ = the upstream particle collection area $A_T$ = the arithmetic sum of the upstream plus downstream areas $A_I$ and $A_D$ $X = K(1-(2/C)^{1.35}$ $C = -\ln(1-\eta_o)$ $\eta_o$ = the nominal operating efficiency of the platewire electrode type electrostatic precipitation absent the high intensity ionization, and between 0.95 and 0.98, and K = between 0.92 $\eta_o^{11}$ and $(8.21 - 7.34\eta_o)/\eta_o^{7.5}$ Another aspect of this invention relates to apparatus for removing fine particles from a gas stream comprising: (a) a first upstream electrostatic precipitator of parallelly spaced plates having an upstream particle collection area $A_I$, a multiplicity of wires equally spaced between each pair of adjacent plates in parallel alignment to each other and positioned at intervals in the longitudinal flow direction from a gas inlet end to a gas discharge end and oriented with the wire length normal to the direction of gas flow, and means for establishing an electric field between such first upstream plates and wires; (b) a high intensity ionizer in flow communication with the gas discharge end of said first electrostatic precipitator (a) comprising a multiplicity of tubular Venturi means as anodes each aligned with the throat section thereof adjacent the first electrostatic precipitator, a disc-shaped member as a cathode positioned within each tubular Venturi means, and means for establishing a high intensity electric field between each of said tubular Venturi means and said disc-shaped member; (c) at least a second downstream electrostatic precipitator in flow communication with the gas discharge end of said high intensity ionizer (b) having the same flow cross-sectional area as said first electrostatic precipitator, comprising parallelly spaced plates having a downstream particle collection area $A_D$, a multiplicity of wires equally spaced between each pair of adjacent plates in parallel alignment to each other and positioned at intervals in the longitudinal flow direction from a gas inlet end to a gas discharge end and oriented with the wire length normal to the direction of gas flow, and means for establishing an electric field between such second downstream plates and wires; with (d) the upstream particle collector area $A_I$, the downstream particle collection area $A_D$ being constructed and the high intensity ionizer being positioned in accordance with the following formulas:

$$A_I = A_T \text{ times } X$$

where $A_I$ = the upstream particle collection area $A_T$ = the arithmetic sum of upstream plus downstream particle collection areas $A_I$ and $A_D$ $X = K(1-(2/C)^{1.35}$ $C = -\ln(1-\eta_o)$ $\eta_o$ = the nominal operating efficiency of the upstream and downstream type electrostatic precipitators (a) and (c) absent the high intensity ionizer (b) and between 0.95 and 0.98, and K = between 0.92 $\eta_o^{11}$ and $(8.21-7.34\eta_o)/\eta_o^{7.5}$, and (e) housing means for enclosing said upstream electrostatic precipitator (a), said high intensity ionizer (b), and said downstream electrostatic precipitator (c).

In the foregoing formulas, $\eta_o$ is the nominal operating efficiency of both the upstream and downstream electrostatic precipitators, operating as an integrated system, without the high intensity ionizer. In general the operating efficiency of plate-wire type electrostatic precipitators can be calculated by performing a mass balance around the electrostatic precipitators as is well-known to one of ordinary skill in this art. The electrostatic precipitator operating efficiency is arithmetically equal to the mass per unit gas volume of gas borne particulates into the electrostatic precipitator minus the particulate mass per unit gas volume discharged from the precipitator, divided by the particulate mass per unit gas volume into the precipitator.

$$\eta_o = \frac{\frac{\text{Mass}}{\text{Vol}}\text{ in} - \frac{\text{Mass}}{\text{Vol}}\text{ out}}{\frac{\text{Mass}}{\text{Vol}}\text{ in}} \times 100\% \quad (2)$$

The mass balance can be performed over any unit time; but preferably the duration over which data is collected is sufficiently long, e.g., 3 hours, to avoid any significant impact due to minor errors in measurement techniques. If for purposes of this invention one wishes to estimate operating efficiency prior to the actual operation of the electrostatic precipitator, then the Deutsch-Anderson equation can be employed as is well-known to one of normal skill. This equation is as follows:

$$\eta_o = 1 - e^{-(w)(A/V)} \quad (3)$$

where

W = the average particle migration velocity or precipitation rate (ft/min)

A = total collection area ($ft^2$)

V = gas volumetric flow rate (CFM)

The quantity W, particle migration velocity, for a particular electrostatic precipitator can typically be obtained from the electrostatic precipitator manufacturer. Alternatively, this factor can be estimated by using any of a larger number of empirical correlations available in the art and well-known to one or ordinary skill. For example, one particularly useful correlation is disclosed in "Electrostatic Precipitation of Fly Ash: Precipitator Design", *Journal of the Air Pollution Control Association*, Harry J. White, Volume 27, No. 3, p. 209.

BRIEF DESCRIPTION OF THE DRAWINGS

FIG. 1 is a schematic drawing taken in cross-section elevation of a high intensity ionizer (HII) assembly followed by a plate-wire electrode type electrostatic precipitator assembly (ESP).

FIG. 2 is a cross-section end view of the FIG. 1 HII assembly taken along line A—A.

FIG. 3 is a cross-section end view of the FIG. 1 ESP assembly taken along line B—B.

It will be noted from the foregoing formulas that this invention only relates to systems in which the nominal operating efficiency of the upstream and downstream electrostatic precipitators is between 0.95 and 0.98. For systems with efficiencies below 0.95 any of a wide variety of conventional means such as modifying the rapping system and improving the gas flow distribution can be more conveniently used to improve performance. This is because the particulates discharged by such low efficiency precipitators contain a large fraction of large-sized particulates which can be easily removed by the precipitator once such conventional modifications are made. For precipitators with nominal efficiencies greater than 0.98, high intensity ionization is not as critically needed to upgrade precipitator performance. This is because other techniques such as increasing the collection corona power, providing gas conditioning to reduce particle resistivity and adding more collection area may be able to provide the required small amount of upgrade.

Figure 4:
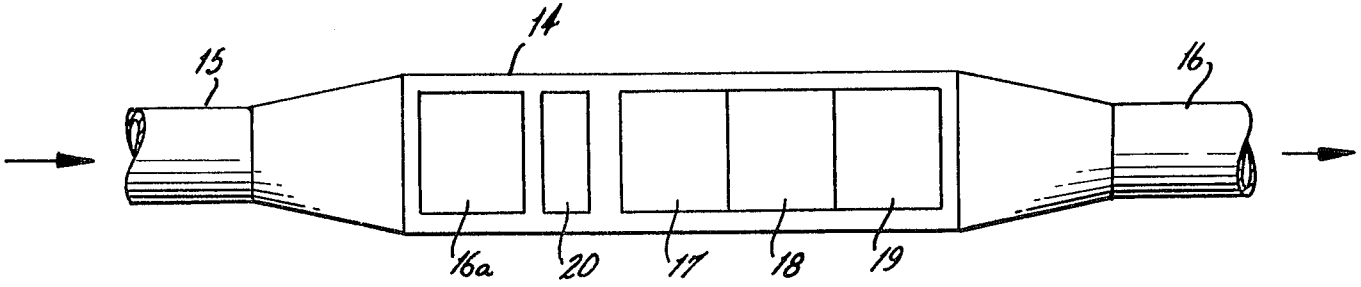
FIG. 4 is a schematic overhead plan view (part in cross-section) of a first (upstream) ESP assembly followed by a single HII assembly and then three succeeding ESP assemblies arranged in series flow relationship, suitable for practicing this invention.
Figure 5:
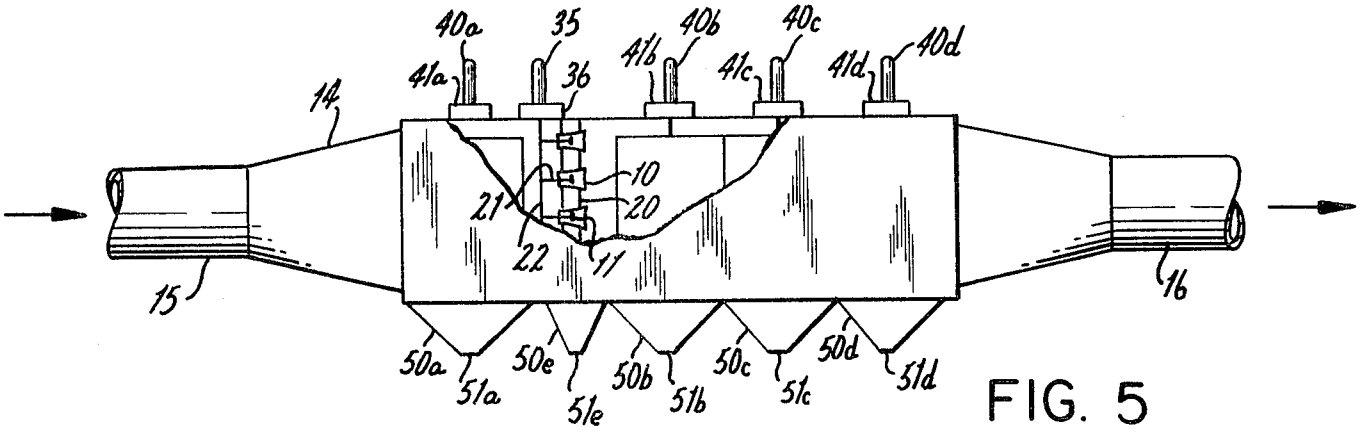
FIG. 5 is a schematic side elevation view (part in cross-section) of the FIG. 4 assembly.

FIGS. 4 and 5 are respectively a schematic overhead plan view and a schematic side elevational view, part in cross-section, of a fine particle removal system according to this invention. The system includes housing 14 having a gas inlet 15 to which the gas containing the gas borne particulates is admitted and an outlet conduit 16 from which clean gas is supplied to appropriate downstream processing. As illustrated, the particle removal system comprises four serially arranged plate-wire electrode type electrostatic precipitators 16*a*, 17, 18 and 19 and a high intensity ionizer or HII assembly 20. As shown, the HII assembly is inserted between the first and second precipitators in accordance with the previous formulas.

Each electrostatic precipitator comprises a plurality of parallelly spaced collection plates and wire electrodes, as for example illustrated in FIGS. 1 and 3. The HII assembly comprises a plurality of Venturi-shaped diffuser anodes and disc shaped cathodes as illustrated in FIGS. 1 and 2. The HII anodes 10 and cathodes 11 are supported in the collection system by means of a central electrode support member 20. The HII anode diffusers present a honeycomb-like array of flow passages to the particulate laden gas stream. The cathode discs 11 are positioned within the Venturi-shaped anodes 10 by means of cathode support members 21. Each cathode support member is coupled to a high voltage busbar network 22. The busbar network is connected to a single busbar 35, which extends from the interior of the collection system through an external conventional high voltage connector shroud 36, and is ultimately connected to a high voltage source (not shown). Each electrostatic precipitator is also provided with a high voltage connector, as shown by 40*a* through 40*d* which is connected to a high voltage source (now shown). The high voltage connector is also connected to a busbar network and ultimately the collector plates of each electrostatic precipitator in the interior of the collection system through the high voltage connector shrouds, as shown by 41*a* through 41*d*.

Each electrostatic precipitator as well as the HII assembly is also provided with a storage hopper or collection bin 50*a* through 50*e*, for collecting the particulate matter that has been removed from the cleaned gas. Each collection bin is provided with a suitable aperture and closure means 51*a* through 51*e* for periodically removing the collected particulates.

In the context of the as-claimed invention and the formulas, the total surface of plates in first electrostatic precipitator 16*a* is the upstream particle collection area $A_I$. The total surface area of plates in electrostatic precipitators 17, 18 and 19 is the downstream collection area $A_D$ (relative to the high intensity ionizer 20), and the arithmetic sum of the upstream and the downstream particle collection areas is $A_T$.

The present invention is based on the discovery that there is an optimum location for a single HII assembly in a particular plate-wire electrode electrostatic precipitator having a known particle collection area $A_T$ and nominal operating efficiency $\eta_o$. The determination of this optimum location is dependent on a variety of conditions including: the nominal operating efficiency of the electrostatic precipitators absent the high intensity ionizer, the inlet particle grain loading to the electrostatic precipitator, the prevailing ambient pressure (gas density), and the particle resistivity. As is known in the prior art, the particle resistivity is dependent upon several conditions of the gas stream including temperature, pressure, humidity and other constitutents in the flue gas.

The positioning of the optimized HII assembly location reflects a balancing of the various contributors, both positive and negative, to the HII and electrostatic precipitator performance. As one moves an HII assembly from its typical prior art location fully upstream of the electrostatic precipitator to a position downstream thereof, several effects occur. First of all, as the HII assembly is moved downstream, the precipitator collection area downstream of the HII array becomes smaller. As a result, the specific collection area of the precipitator augmented by the enhanced charging capabilities of the HII assembly diminishes and the HII is not used to its fullest potential. The total charge imparted to the entrained particulates by the HII also decreases as the HII is moved downstream. Similarly, when the HII is moved downstream it is augmenting a section of the precipitator which typically has the lowest migration velocity. On the other hand, HII performance is improved as the grain loading of the gas entering the HII decreases, which produces a smaller amount of corona quenching. This allows the HII to operate more closely to its maximum design capabilities in terms of achieveable corona power density and specific corona current. The space charge density in the zone between the HII array and the downstream precipitation field also decreases, so that the chance of discharge and arcing, which tend to diminish the charging capability of an HII, are significantly reduced. Additional effects favoring a downstream location include, the flow mal-distribution caused by the HII assembly, the HII influences a smaller fraction of the collection area, and the HII is imparting all its charging potential to smaller particles which are typically more difficult to collect.

Based on these competing factors, it was unexpectedly discovered that there exists a unique otpimum range for HII location at which the HII—electrostatic precipitator performance is maximized and that this range normally lies within the range of 12% to 45% of the total precipitator length, and preferably between 25% and 42%. It should be noted that in the method of this invention, the gas velocity in the upstream and downstream electrostatic precipitator steps is the same. Also, in the claimed apparatus the first upstream and second downstream electrostatic precipitator have the same cross-sectional area. Accordingly, the precipitator length and collection areas and fractions thereof are directly proportional and are interchangeable.

Figure 6:
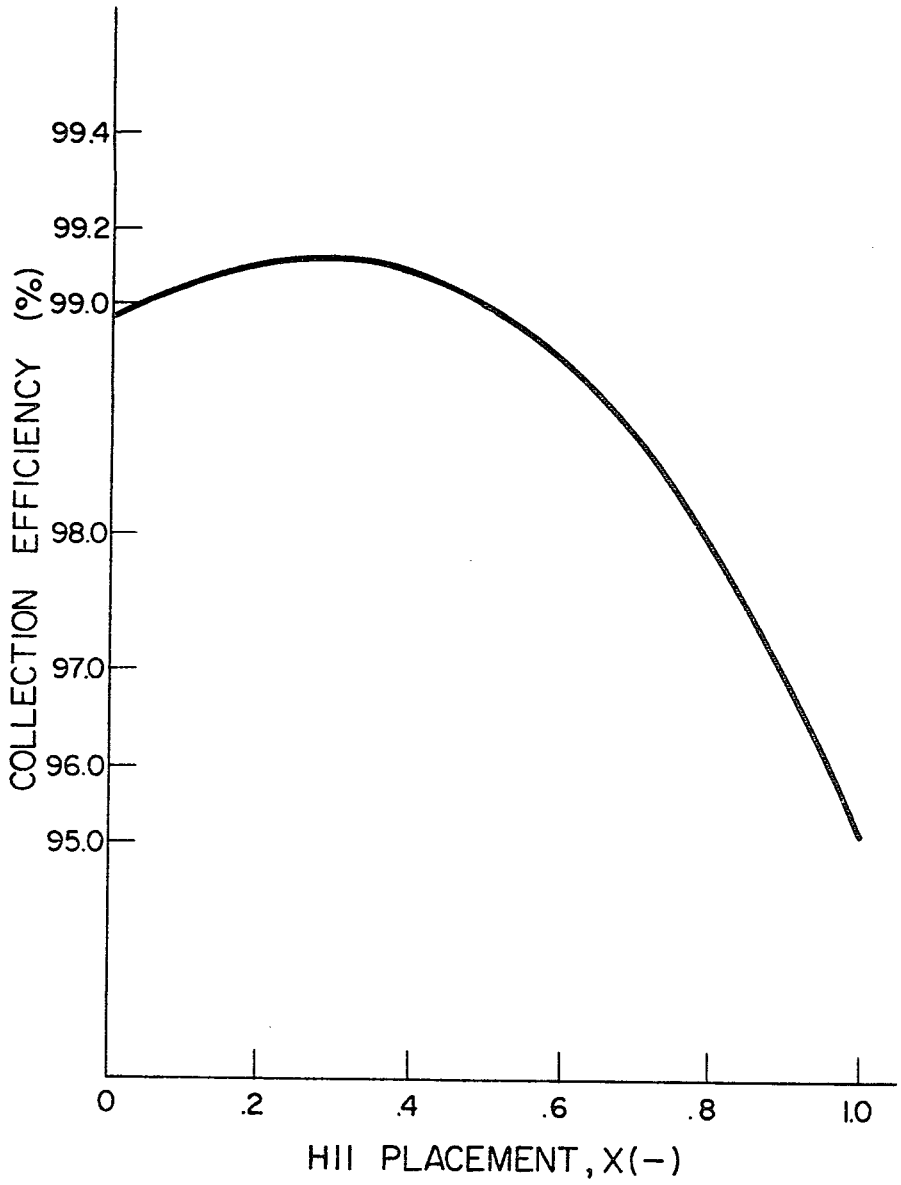
FIG. 6 is a graph showing the particle collection efficiency as a function of HII placement in a series of plate-wire electrode ESP assemblies, with the HII placement progressively moving from the ESP inlet end to the discharge end, with $\eta_o$ value of 95% (nominal collection efficiency of the ESP system absent the HII).
Figure 7:
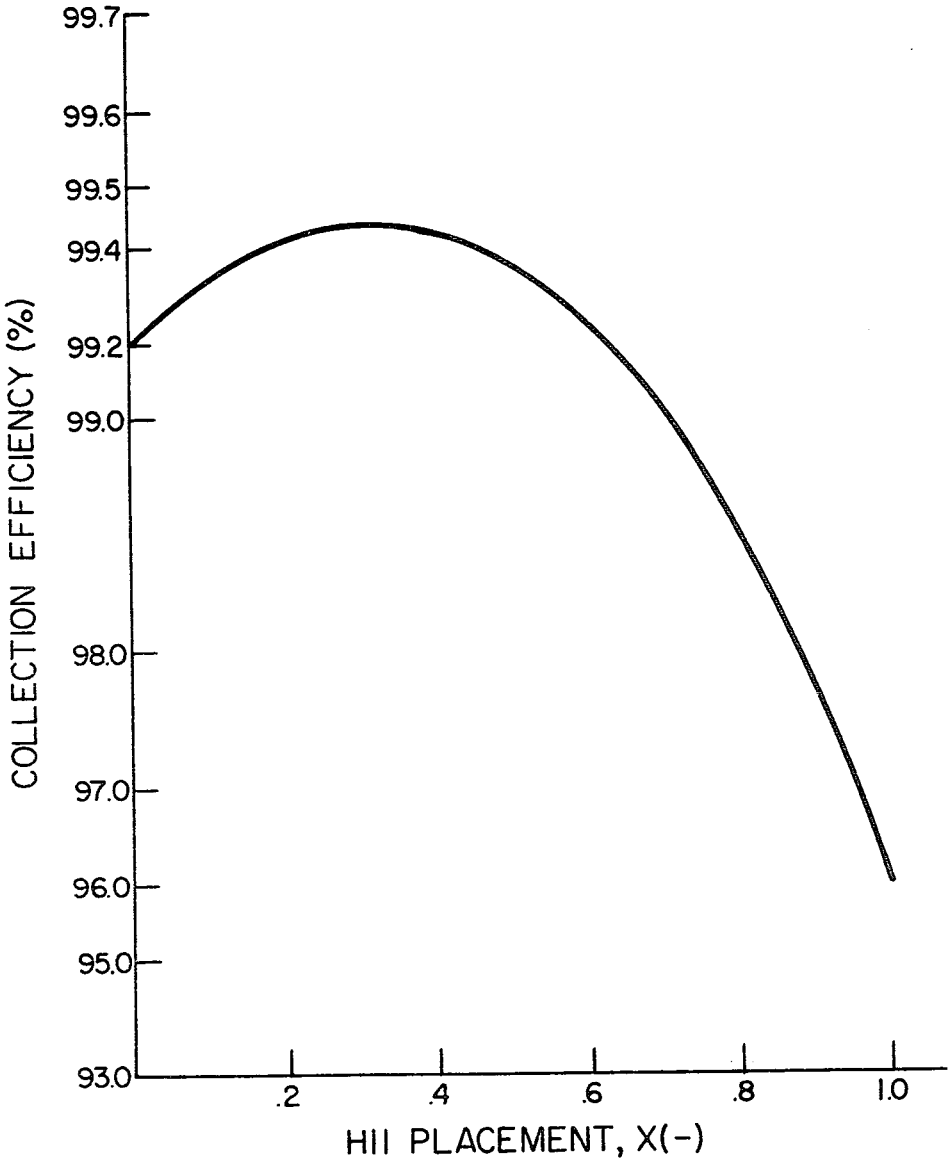
FIG. 7 is a graph identical to FIG. 6 except that the $\eta_o$ value is 96%.
Figure 8:
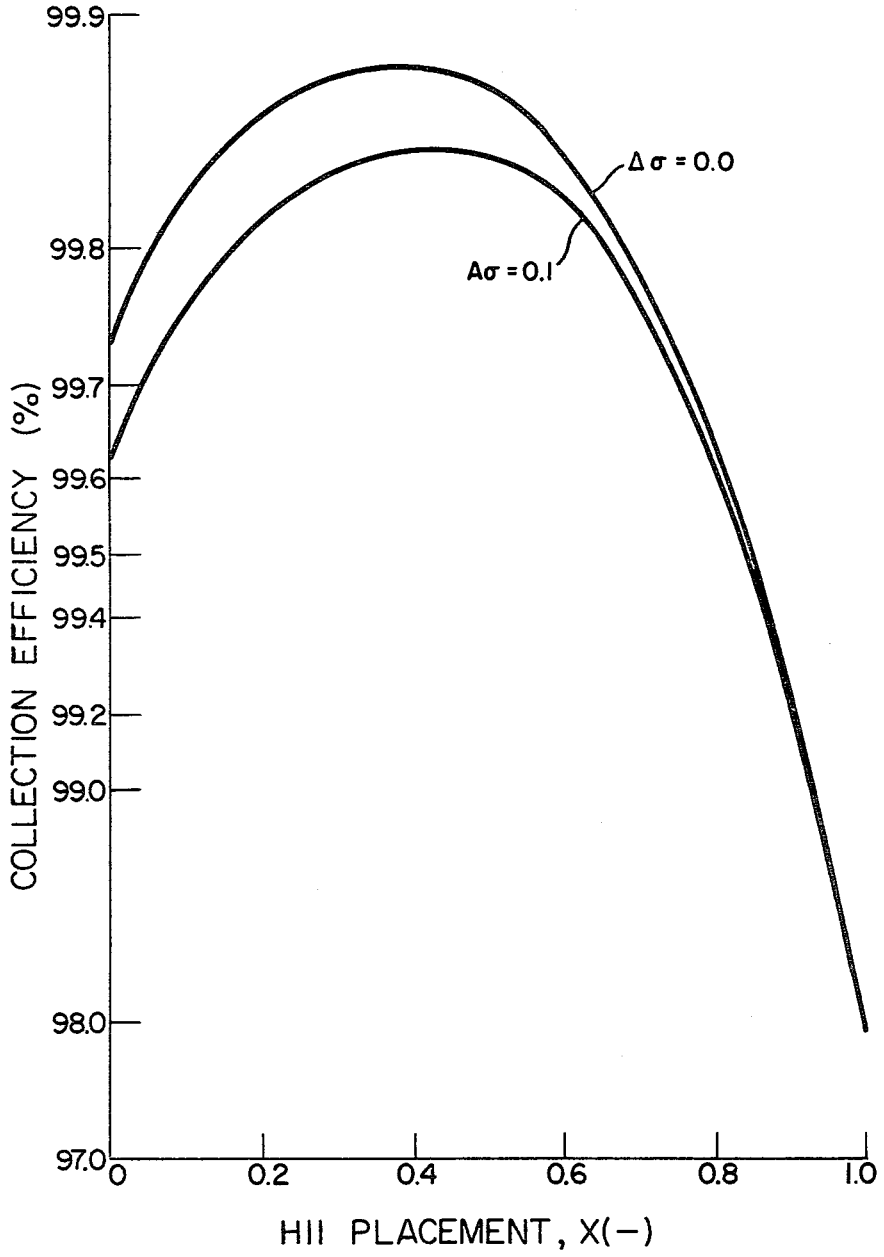
FIG. 8 is a graph identical to FIG. 6 except that the $\eta_o$ value is 98% and there are two curves showing the effect of minor changes in the gas flow distribution in the ESP assemblies.

The practice of this invention is illustrated by FIGS. 6, 7 and 8 which are plots of the particle collection efficiency as the ordinate for a particular apparatus comprising platewire electrode type electrostatic precipitators of 95%, 96% and 98% nominal operating efficiency respectively, and a single high intensity ionizer assembly in which the HII placement is progressively moved from the electrostatic precipitator inlet end to the discharge end of the final electrostatic precipitator. Also for purposes of these illustrations, the following conditions were assumed:

(a) Inlet grain G loading to the first electrostatic precipitator is 3.5 grains/actual cubic foot of gas flow, (b) Feed gas is a flue gas from a coal-fired boiler with fly ash particles of a mass mean diameter of 15 $\mu$m, (c) Average particle resistivity ($\rho$) is $1\times10^{11}$ ohm-cm.

(d) Purge gas flow as a fraction of the total gas flow ($\alpha$) is 0.07.

(e) Gas flow rate (Q) is 750,000 actual $ft^3$/minute.

(f) Specific collection area of the electrostatic precipitator (SCA) is in $ft^2$/1000 actual cubic feet of gas flow per minute (ACFM) and reflects the efficiency of the system. The values are 233 for FIG. 6, 250 for FIG. 7, and 304 for FIG. 8.

(g) Plate length of the electrostatic precipitators in the gas flow direction (from the leading edge of first field to trailing edge of last field) is 36 feet.

In the curves of FIGS. 6–8, the particle collection efficiency with the high intensity ionizer positioned upstream all the electrostatic precipitators in the prior art fashion is represented by an X value of zero. Conversely, the particle collection efficiency with the HII positioned fully downstream the electrostatic precipitators is represented by an X value of 1.0 and is equivalent to the nominal operating efficiency of the electrostatic precipitators without the HII, or $\eta_o$. The difference between the two extreme values for X represents the particle collection efficiency augmentation attributable to the HII assembly when used in the typical prior art manner—upstream all of the electrostatic precipitators.

Rather than being some type of a decaying funtion between these two limits, FIGS. 6–8 illustrate that the particle collection efficiency unexpectedly rises with progressively decreasing positive slope from the HII inlet end position to a maximum value. The efficiency curve thereafer initially decreases with increasingly negative slope until reaching the nominal precipitator operating efficiency $\eta_o$. Comparing the three curves, it will be noted that the maximum collection efficiency for the 98% nominal operating efficiency curve of FIG. 8 is the highest—about 99.885%. On the other hand, the absolute increase in collection efficiency from the value at X=0 is about the same for all three curves—about 0.19%.

The improvement in fine particle collection illustrated by FIGS. 6–8 represents a significant advance in the art, as fine particles typically represent the severest problem for removal and normally are the bulk of the particulates escaping conventional collection techniques.

In the comparisons of FIGS. 6–8, particle collection is displayed as percent removal but may also be quantified. The improvement in fine particle removal provided for by one collection device relative to another collection device may be conveniently quantified by percent reduction in penetration. Percent reduction in penetration is defined by the following equation:

$$P = \frac{(1-\eta_1)-(1-\eta_2)}{(1-\eta_1)} \times 100\% \quad (4)$$

where

P=percent reduction in penetration $\eta_1$=collection efficiency of the less efficient collection device and $\eta_2$=collection efficiency of the more efficient collection device Specifically, this parameter reflects the additional fraction of particulates that one collection device is able to remove beyond what a less efficient collection device was able to remove. At high collection efficiencies, involving HII, the percent improvement can be primarily attributed to increased fine particle collection. The percent reduction in penetration provided by locating the HII in an optimum position in the FIGS. 6 through 8 designs, as compared with HII location fully upstream of the electrostatic precipitator assembly and with HII location at the mid-point, is shown in Table A. As shown, the present invention provides a substantial overall reduction in penetration in each of the illustrated cases relative to the two alternative designs listed.

TABLE A

| Nominal Electrostatic Precipitator Collection Efficiency (%) | Fly Ash Optimum HII Location (X) | Percent Reduction in Penetration (%) Provided By Optimum Location of HII Relative To: Upfront Location | Midpoint Location |
|---|---|---|---|
| 95 | 0.29 | 17.1 | 13.9 |
| 96 | 0.31 | 30.0 | 11.0 |
| 98 | 0.39 | 41.0 | 8.0 |

When HII electrostatic precipitation assemblies are designed in accordance with this invention and in particular formula (1), the particle collection efficiency will be in the region of the maximum value shown by FIGS. 6–8 if the X value (the HII placement) is in the following ranges:

| Nominal Operating Efficiency ($\eta_o$) | X Values |
|---|---|
| 95 | 0.12–0.42 |
| 96 | 0.16–0.43 |
| 97 (by interpolation) | 0.21–0.44 |
| 98 | 0.28–0.45 |

It will be noted from this table that the invention is well suited for retrofit installations where there are several equally-sized electrostatic precipitator collector sub-assemblies in existance, and the practionier wishes to add a single high intensity ionizer assembly to improve particle collection efficiency. By way of illustration, if there are four existing sub-assemblies and the nominal operating efficiency $\eta_o$ is 0.95 then a convenient arrangement is to insert the HII assembly between the first and second electrostatic precipitators subassemblies, i.e., such that 25% of the collection area is located upstream the HII. This arrangement minimizes the necessary modifications. However, if additional electrostatic precipitation collection area is to be supplied to an existing installation or if the particulate removal system is for an entirely new facility, it may be preferable to design closer to the optimum point. Preferably, the HII assembly is located such that between 23% and 33% of the electrostatic precipitation area is upstream the HII, that is, an X value of 0.23–0.33.

One parameter to be considered in connection with this invention is the change in sigma, $\Delta\sigma$, which represents the change in the gas flow distribution in the downstream electrostatic precipitator due to the HII assembly. Normally, the value of this parameter will be gathered by experiment, but may be estimated from the system design.

A given electrostatic precipitator will have a given gas flow distribution through the parallelly arranged flow channels. Ideally, each point in every flow channel will have the same local or average gas velocity $U_o$. However, due to various factors, the flow will be nonuniform, and will vary in any one flow channel as well as between flow channels from the average value. The magnitude of this variation can be statistically quantified by calculating the standard velocity deviation of the various gas velocities through the electrostatic precipitator flow channels using the equation $$\sigma = \sqrt{\left(\frac{1}{n}\right) \sum_{i=1}^{n} (u_i - u_o)^2/u_o^2}$$

where $$U_o = \text{the average gas velocity} = \sum_{i=1}^{n} U_i/n = Q/A$$

$U_i$=the actual local gas velocity at location i within the cross-sectional area of gas flow n=the number of flow locations measured Q=the actual volumetric flow rate A=the cross-sectional area available for flow.

In order to determine $\Delta\sigma$ the value of $\sigma$ is experimentally determined or predicted for the electrostatic precipitator alone, and then for the electrostatic precipitator including the HII assembly. The difference between these two values equals $\Delta\sigma$ and represents the alteration of the flow distribution due to the HII assembly.

As the value of $\Delta\sigma$ increases the particle collection efficiency of the HII-electrostatic precipitator assembly decreases and the optimum location for the HII assembly shifts to a position further downstream, as shown in FIG. 8 for $\Delta\sigma=0$ and $\Delta\sigma=0.1$. As illustrated, the value for the optimum HII position X is only marginally influenced by the $\Delta\sigma$ factor. Moreover, since the value of $\Delta\sigma$ for a well-designed system should be small, and will typically be below 0.1, I have found that negligible error is introduced by neglecting the influence of this factor. For this reason, the formulas presented hereinbefore adequately describe this invention.

Table B lists pertinent design data for a plate-wire electrode type system. The gas flow rate, inlet grain loading and average particle resistivity are typical of a fly ash-containing flue gas stream from a coal-fired electrical generating power station. As listed, the nominal operating efficiency of the electrostatic precipitator system under these conditions is 98%. By utilizing the present invention this efficiency can be significantly improved.

According to equation (1) and the defining equations associated therewith, in order to achieve optimum improvement an HII assembly should be located at a position such that between 63,840 ft$^2$ and 102,600 ft$^2$ of the total electrostatic precipitator collection area of 228,000 ft$^2$ is upstream of the HII. This corresponds to an HII placement X of between 0.28 and 0.45 and is equivalent to locating the HII assembly in such a fashion that between 10 feet and 16.1 feet of the total electrostatic precipitator length of 36 feet is located prior to the HII assembly. Within this range of potential positions the resulting HII-electrostatic precipitator operating efficiency will be above 99.875%. As defined by equation (4), this represents at least a 94% reduction in penetration relative to the nominal electrostatic precipitator operating efficiency of 98%. The actual optimum location of the HII assembly for this system is at a position such that 88,920 ft$^2$ of collection area is upstream of the HII assembly. This corresponds to an HII placement value X of 0.39 and is equivalent to locating the HII assembly with 14 ft. of electrostatic precipitator collection length upstream of the HII. The resulting operating efficiency at this location is 99.885%.

TABLE B

| TYPICAL SYSTEM DESIGN | |
|---|---|
| Flow Rate (ACFM) | 750,000 |
| Electrostatic Precipitator Collection Area (ft$^2$) | 228,000 |
| Total Collector Plate Length (ft) | 36 |
| Base Electrostatic Precipitator Collection Efficiency (%) | 98.0 |
| Inlet Grain Loading (Gr/ACF) | 3.5 |
| Average Particulate Resistivity (ohm-cm) | $10^{11}$ |
| Ambient Pressure (atm) | 1.0 |

Although preferred embodiments of the invention have been described in detail, it will be appreciated that other embodiments are contemplated, along with modifications of the disclosed features, as being within the scope of the invention. For example, as used herein the term plate-wire electrode type electrostatic precipitator is used to broadly describe any of the well-known designs of single-stage electrostatic precipitators in which the discharge electrode may take the form of thin members with circular, square or other cross-section, barbed configuration or thin strips of metal which may be stamped or formed into various shapes. Various shapes of suitable wire electrodes for practicing this invention are for example described in "The Electrostatic Precipitator Manual", published by the McIlvaine Company, Northbrook, Ill., Vol. 1, Chapter III, page 2.04.

In a similar fashion, the expression plate electrode for an electrostatic precipitator should not be limited to flat plates but may also encompass rippled or corrugated plates. Additionally, such electrodes usually include a plurality of approximately shaped fins which extends into gas flow channel and are designed to keep particle reentrainment losses at a minimum, as is well-known to one of ordinary skill.

What is claimed is:

1. In a method for removing fine particles from a feed stream in which the particles in the feed gas stream are charged in a single high intensity ionization step and the charged particles are thereafter collected in a downstream plate-wire electrode type electrostatic precipitation step: the improvement comprising first passing the fine particle—containing feed gas stream through an upstream plate-wire electrode type electrostatic precipitation step prior to said charging at the same gas velocity as the downstream electrostatic precipitation step with the upstream particle collection area $A_I$ in said upstream plate-wire electrode type electrostatic precipitation step and the downstream particle collection area $A_D$ in said downstream plate-wire electrode type electrostatic precipitation step and X the fraction of the arithmetic sum $A_T$ of $A_I$ and $A_D$ which is represented by $A_I$, all in accordance with the following formulas:

$$A_I = A_T \text{ times } X$$

where $A_I$ = the upstream particle collection area $A_T$ = the arithmetic sum of upstream plus downstream particle collection areas $A_I$ and $A_D$ $X = K(1-2/C)^{1.35}$ $C = -\ln(1-\eta_o)$ $\eta_o$ = the nominal operating efficiency of the upstream and downstream plate-wire electrode type electrostatic precipitation absent the high intensity ionization and being between 0.95 and 0.98, and K = between $0.92\eta_o^{11}$ and $(8.21-7.34\ \eta_o)/\eta_o^{7.5}$.

2. A method according to claim 1 in which the upstream particle collection area $A_I$ is between 0.25 and 0.41 of the total particle collection area $A_T$.

3. A method according to claim 2 in which the particles are fly ash, the nominal operating efficiency $\eta_o$ of the upstream and downstream precipitators is 0.95, and the upstream particle collection area $A_I$ is 0.29 of the total particle collection area $A_T$.

4. A method according to claim 3 in which the particles are fly ash, the nominal operating efficiency $\eta_o$ of the upstream and downstream precipitations is 0.98, and the upstream particle collection area is 0.39 of the total particle collection area $A_T$.

5. A method according to claim 2 in which the particles are fly ash, the nominal operating efficiency $\eta_o$ of the upstream and downstream precipitators is 0.96, and the upstream particle collection area is 0.31 of the total particle collection area $A_T$.

6. Method according to claim 1 in which the particles are fly ash and the nominal operating efficiency $\eta_o$ of the upstream and downstream electrostatic precipitation is between 0.965 and 0.98.

7. Apparatus for removing fine particles from a gas stream comprising:

(a) a first upstream electrostatic precipitator of parallelly spaced plates having an upstream particle collection area $A_I$, a multiplicity of wires equally spaced between each pair of adjacent plates and positioned at intervals in the longitudinal flow direction from a gas inlet end to a gas discharge end and oriented with the wire length nominal to the direction of gas flow, and means for establishing an electric field between such first upstream plates and wires;

(b) a high intensity ionizer in flow communication with the gas discharge end of said first electrostatic precipitator (a) comprising a multiplicity of tubular Venturi means as anodes each aligned with the throat section thereof adjacent the first electrostatic precipitator. A disc-shaped member as a cathode positioned within each tubular Venturi means, and means for establishing a high intensity electric field between each of said tubular Venturi means and said disc-shaped member;

(c) at least a second downstream electrostatic precipitator in flow communication with the gas discharge end of said high intensity ionizer (b) having substantially the same flow cross-sectional area as said first electrostatic precipitator comprising parallelly spaced plates having a downstream particle collection area $A_D$, a multiplicity of wires equally spaced between each pair of adjacent plates in parallel alignment to each other and positioned at intervals in the longitudinal flow direction from a gas inlet end to a gas discharge end and oriented with the wire length normal to the direction of gas flow, and means for establishing an electric field between such second downstream plates and wires; with (d) the upstream particle collector area $A_I$, the downstream particle collection area $A_D$ being constructed and the high intensity ionizer being positioned with X the fraction of the arithmetic sum $A_T$ of $A_I$ and $A_D$ which is represented by $A_I$, all in accordance with the following formulas:

$$A_I = A_T \text{ times } X$$

where $A_I$ = the upstream particle collection area $A_T$ = the arithmetric sum of upstream plus downstream particle collection areas $A_I$ and $A_D$ $X = K(1-2/C)^{1.35}$ $C = -\ln(1=\eta_o)$ $\eta_o$ = the nominal operating efficiency of the upstream and downstream type electrostatic precipitators (a) and (c) absent the high intensity ionizer (b) and between 0.95 and 0.98, and K = between $0.92\ \eta_o^{11}$ and $(8.21-7.34\ \eta_o)/\eta_o^{7.5}$ (e) housing means for enclosing said upstream electrostatic precipitator array (a), said high intensity ionizer (b), and said downstream electrostatic precipitator (c).

8. Apparatus according to claim 7 in which the upstream particle collection area $A_I$ is between 0.25 and 0.41 of the total particle collection area $A_T$.

* * * * *